United States Patent [19]

Melvin

[11] Patent Number: 4,520,788

[45] Date of Patent: Jun. 4, 1985

[54] ROTATING WHEEL DRESSER

[76] Inventor: Larry E. Melvin, R.D. #1, Cambridge Springs, Pa. 16403

[21] Appl. No.: 532,211

[22] Filed: Sep. 14, 1983

[51] Int. Cl.[3] ..... B24B 53/06

[52] U.S. Cl. ..... 125/11 CD; 125/11 N; 125/11 DF

[58] Field of Search ..... 125/11 DF, 11 CD, 11 R, 125/11 N, 39

[56] References Cited

U.S. PATENT DOCUMENTS

| | | | |
|---|---|---|---|
| 1,562,941 | 11/1925 | Conners | 125/11 CD |
| 2,199,053 | 4/1940 | Meeson | 125/11 CD |
| 2,458,605 | 1/1949 | Kirin | 125/11 CD |
| 2,715,800 | 8/1955 | Indge | 125/11 CD |
| 2,827,037 | 3/1958 | Wallace | 125/11 CD |
| 3,822,689 | 7/1974 | Oghima | 125/11 DP |
| 4,083,350 | 4/1978 | Zogas | 125/11 CD |

*Primary Examiner*—Harold D. Whitehead

*Attorney, Agent, or Firm*—Wayne L. Lovercheck; Charles L. Lovercheck; Dale R. Lovercheck

[57] ABSTRACT

A wheel dresser for precision grinding wheels made up of a housing supporting a rotatable diamond tool with a flat end and a housing supporting the two at an angle to the side edge of the wheel to be dressed. Base of the wheel dresser is magnetic and can be supported on a magnetic table. The dresser is adapted to be supported on a machine where the grinding wheel and table are adjustable up and down relative to one another. The tool is rotatable about its longitudinal axis so that it may cool and only a part of the cutting edge be engaged with the grinding wheel at any one time. The wheel can be dressed by moving the tool radially of the wheel.

13 Claims, 4 Drawing Figures

ROTATING WHEEL DRESSER

REFERENCE TO PRIOR ART

The following patents are known to Applicant; U.S. Pat. Nos.:

4,083,350
2,891,211
2,845,920
2,151,684
2,888,005

All of these patents show tools for dressing the outer periphery of a grinding wheel, but none of them show tools suitable for dressing the side edge of a wheel by moving the tool radially of the wheel.

SHORT STATEMENT OF THE INVENTION

Many efforts have been made to provide an efficient tool dresser for dressing the side of a wheel, but none have provided a wheel dresser specially adapted to dress the side edge of a wheel with a single pass of the tool moving radially across the wheel.

OBJECTS OF THE INVENTION

It is an object of the invention to provide an improved wheel dresser which will dress a wheel in less time than known wheel dressers, will use fewer diamonds, and provide a cleaner and quieter operation than conventional methods of wheel dressing.

Another object of the invention is to provide a grinding wheel dresser that is simple in construction and economical to manufacture and simple to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

Other objects, features, and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
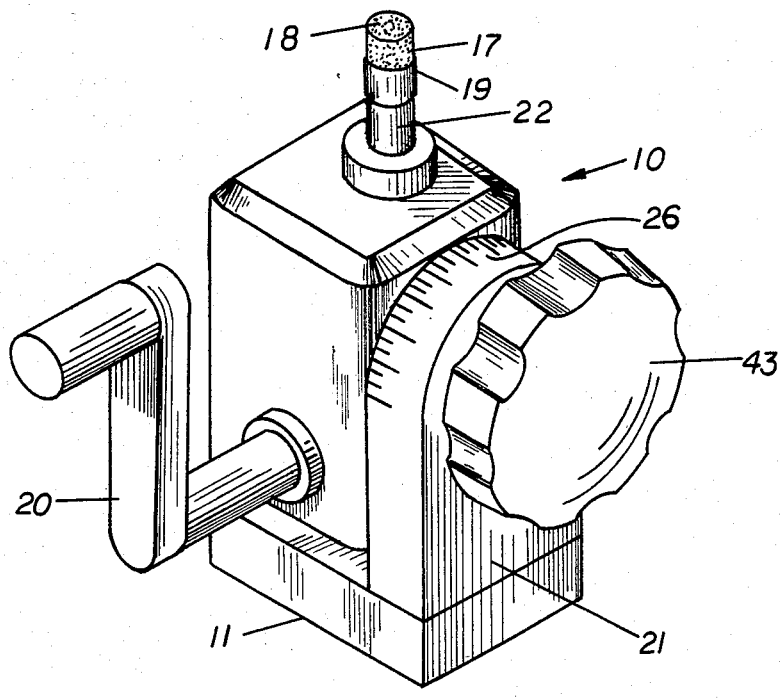
FIG. 1 is an isometric view of a preferred embodiment of the wheel dresser according to the invention.
Figure 2:
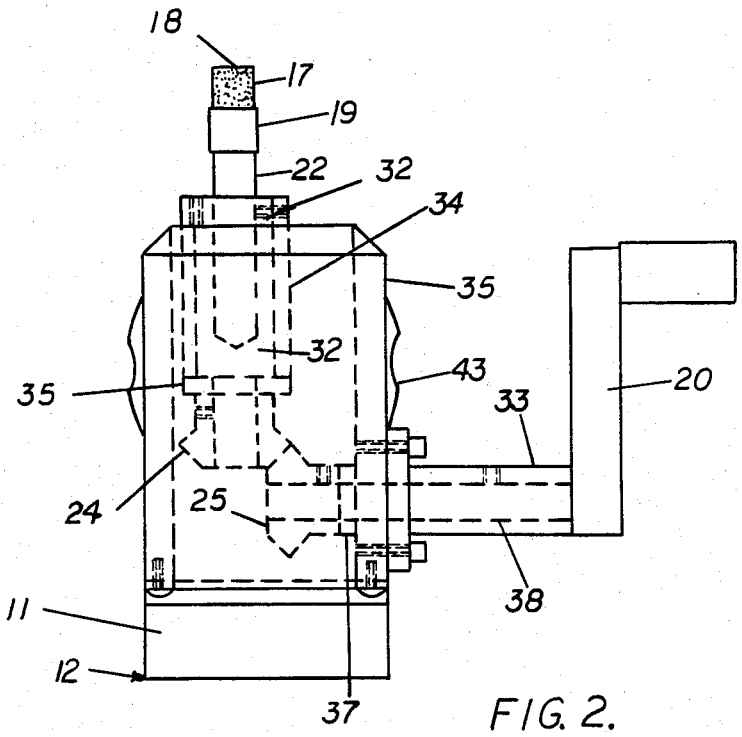
FIG. 2 is a back view of a preferred embodiment of the housing of the wheel dresser showing the enclosed parts in phantom lines.

The preferred embodiment of the present invention is illustrated by way of example in FIGS. 1–4. With specific reference to FIGS. 1 and 2, the wheel dresser is shown generally at 10 having a base 11 with a generally flat lower surface 12 adapted to rest on a magnetic table

13 of a grinding machine 14. A vertical section 21 is attached to the base and extends upwardly therefrom.

Figure 3:
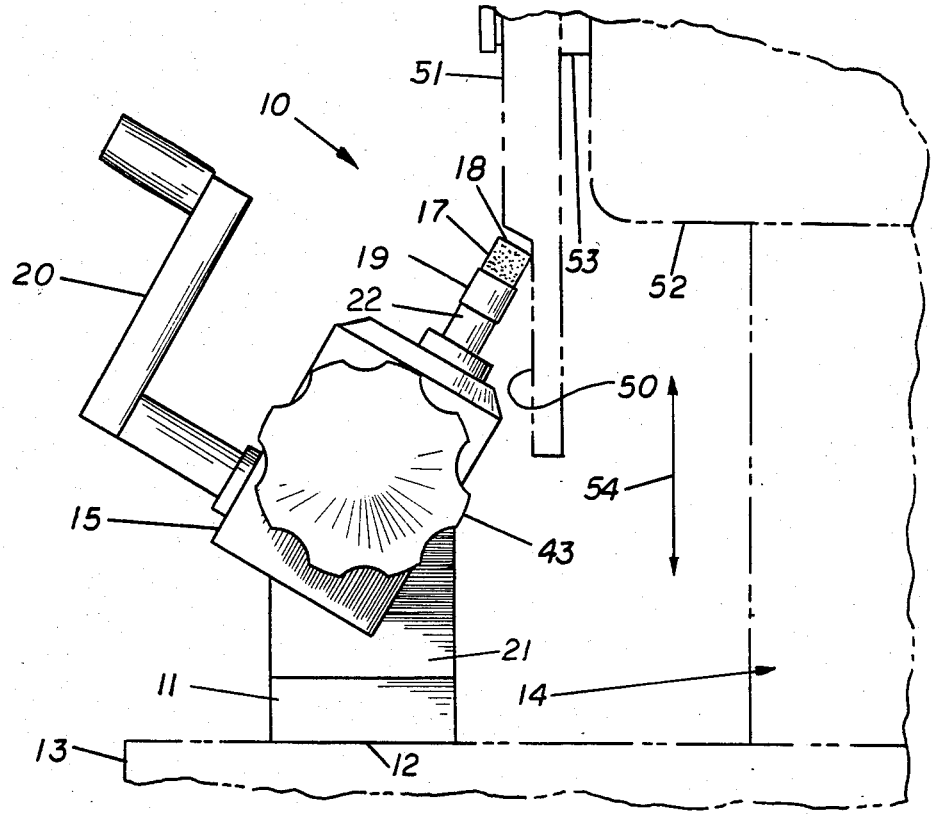
FIG. 3 is a front view of a preferred embodiment of the wheel dresser with the tool inclined into the wheel in a working position according to the invention; and, FIG. 4 is a side view of a preferred embodiment of the wheel dresser taken at 90° to the view shown in FIG. 2.

A housing 15 is swingably attached to the vertical section 21 and is swingable about a horizontal axis 16. An elongated generally cylindrical tool 17 having a flat end 18 is rotatably supported on the housing 15 and means is provided on the housing to rotate the tool about its longitudinal axis. The cylindrical tool 17 is preferably a cylindrical impregnated diamond tool mounted to a round shank 22. A collar 19 may be provided to mount the tool to the shank. The means to rotate the tool is the crank 20. The housing 15 may be moved up and down relative to the wheel by adjusting either the table up and down relative to the wheel or adjusting the wheel up and down relative to the table so that the cylindrical tool 17 having the flat end 18 will move up and down over the surface 50 of the wheel being dressed. The wheel is indicated generally at 51 and is supported on a motor 52 which has a shaft 53 carrying the wheel. The movement of the wheel up and down is shown in FIG. 3 as indicated by the arrow 54.

The upper end of the vertical section 21 of the base 11 is rounded and calibrated by calibration lines 26 in degrees and a reference mark is provided on the chamferred edge 42 so that the hand wheel 43 may be loosened and the housing 15 can be rotated to change the angle of the tool 17 to the wheel 51.

The spindle 32 is supported in the housing 35 in a bushing 34 and the spindle has a bevel gear 24 on its lower end which meshes with bevel gear 25 and bevel gear 25 which is supported on a shaft 38 which is connected to the crank 20 for rotating the tool 17.

The housing 35 has a bore in its top that receives the bushing 34 which holds the spindle 32 in place. The housing 35 has a thrust washer 35' under the bushing behind the bevel gear 24. Shaft 38 is rotatably supported in shaft housing 33 and bevel gear 25 meshes with gear 24 and crank 20 is attached to the shaft 38 thus the operator can rotate the crank 20 to rotate the tool 17. Spindle 32 may be inclined to the desired degree by moving the hand wheel 43 which is threadably received in the body housing 15 thereby unclamping housing 35 and allowing it to swing on base 11.

It has been discovered that by rotating the tool 17 the cut can be made by moving the tool 17 radially of the grinding wheel 51 and a great deal of time can be saved over conventional wheel dressing equipment. Applicant believes that this is because the heating of the tool is alleviated and that a diamond tool cuts better if its the cutting elements are moved relative to the work being cut. By tipping or inclining the tool toward the wheel to be dressed the wheel will pass the housing as the tool is advanced into the wheel. Inclining the tool also keeps a sharp edge of the diamond in the corner where cutting occurs.

Figure 4:
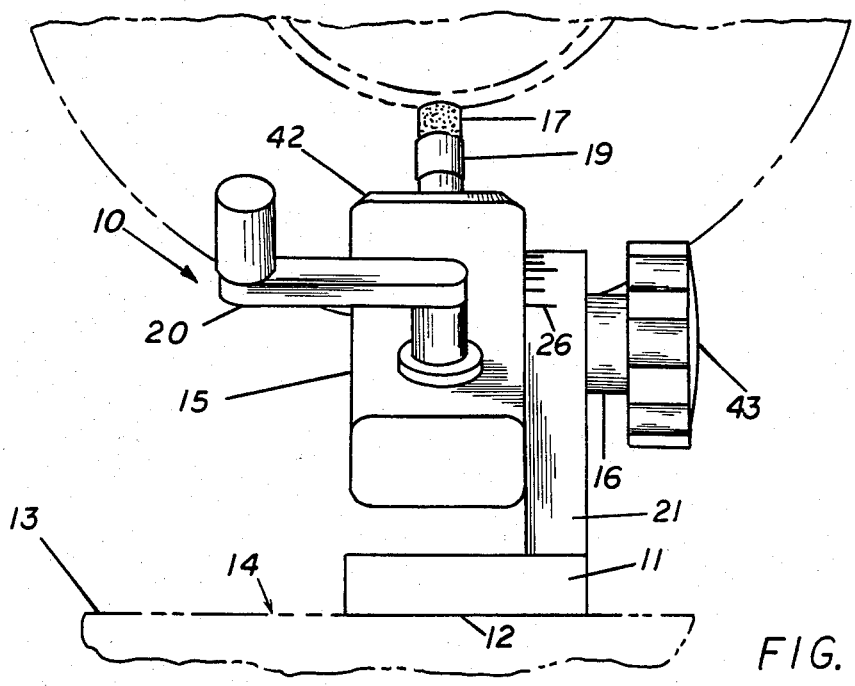

Referring now to FIGS. 3 and 4, the wheel dresser is shown with the cylindrical tool 17 inclined into the wheel 51 which enables an operator to narrow a wheel a desired amount in a single pass, as opposed to the conventional practice of moving a tool many times past the wheel.

The present invention provides an improved wheel dressing apparatus which can be easily manipulated for the purpose of narrowing or dressing a wheel. The wheel dresser has a simple and reliable system for inclining the tool and fixing the tool in a desired inclined position. This improved wheel dressing apparatus requires less time for wheel cutting the conventional apparatus, using a smaller quantity of diamonds (less wear on the tool), provides a cleaner operation in that the steady flow of debris from this dressing tool is containable by conventional means. The conventional dressing operation tends to send debris in all directions. Finally, the operation of this dressing apparatus is quieter than conventional wheel dressing apparatus.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A wheel dresser having a base with a generally flat lower surface adapted to rest on a magnetic table of a grinding machine, a vertical section attached to said base, said vertical section extending upwardly therefrom, a housing swingably attached to said vertical section and swingable about a horizontal axis, an elongated generally cylindrical diamond impregnated tool having a flat dressing end means rotatably supported on said housing, manually rotatable means on said housing to manually rotate said tool about its longitudinal axis, said housing being adapted to be moved up and down relative to a rotating grinding wheel with a part of said flat end of said tool in contact with said wheel, said tool adapted to be moved radially of the wheel in a vertical path when the wheel and table are moved relative to each other whereby a side of said wheel may be dressed.

2. The combination recited in claim 1 wherein said means supporting said tool on said housing comprises a spindle rotatably supported on said housing and manual means for rotating said spindle.

3. The wheel dresser recited in claim 2 wherein said means to rotate said tool comprises a hand crank extending laterally from said housing and rotatable about an axis generally perpendicular to said longitudinal axis of said tool.

4. The tool dressing device recited in claim 3 wherein said tool has diamond means supported thereon.

5. The dressing device recited in claim 4 wherein the outer peripheral edge of said flat end is adapted to engage said wheel.

6. The wheel dressing device recited in claim 5 wherein said crank is connected to said spindle by means of two bevel gears.

7. The tool dressing device recited in claim 6 wherein the upper end of said vertical leg is arcuate in shape and is calibrated in degrees and a reference mark is formed on said housing to cooperate with said calibrations.

8. In combination, a grinding wheel to be dressed, a machine having a movable table with a magnetic chuck supporting a fixture having a diamond impregnated tool thereon, said fixture having a base with a horizontal part resting on said table and a vertical part affixed thereto, a housing means rotatably supported on said vertical part of said base, an elongated spindle supported on said housing, said diamond impregnated tool comprising an elongated generally cylindrical tool having a flat dressing end supported on said spindle, manually moveable means on said housing to rotate said spindle thereby rotating said tool about its longitudinal axis while said grinding wheel is rotating, means on said vertical part of said base permitting said housing to rotate about an axis perpendicular to said longitudinal axis of said tool and means to lock said housing holding said tool at a predetermined angle relative to said grinding wheel whereby a side edge of said wheel can be dressed when the tool is moved radially of the wheel.

9. The combination recited in claim 8 wherein said means supporting said tool on said housing comprises a spindle rotatably supported on said housing and manual means for rotating said spindle.

10. The wheel dresser recited in claim 9 wherein said means to rotate said tool comprises a hand crank extending laterally from said housing and rotatable about an axis generally perpendicular to said longitudinal axis of said tool.

11. The dressing device recited in claim 10 wherein the outer peripheral edge of said flat end is adapted to engage said wheel.

12. The wheel dressing device recited in claim 11 wherein said crank is connected to said spindle by means of two bevel gears.

13. The tool dressing device recited in claim 12 wherein the upper end of said vertical leg is arcuate in shape and is calibrated in degrees and a reference mark is formed on said housing to cooperate with said calibrations.

* * * * *